US010071557B2

(12) United States Patent
Wilson et al.

(10) Patent No.: US 10,071,557 B2
(45) **Date of Patent: *Sep. 11, 2018**

(54) PRINTHEAD ASSEMBLY WITH FLUID INTERCONNECT COVER

(71) Applicant: HEWLETT-PACKARD DEVELOPMENT COMPANY, L.P., Houston, TX (US)

(72) Inventors: Rhonda L. Wilson, Monmouth, OR (US); Mark A. Devries, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/260,044

(22) Filed: Sep. 8, 2016

(65) Prior Publication Data

US 2016/0375689 A1 Dec. 29, 2016

Related U.S. Application Data

(63) Continuation of application No. 14/770,316, filed as application No. PCT/US2013/033073 on Mar. 20, 2013, now Pat. No. 9,493,008.

(51) Int. Cl.
*B41J 2/175* (2006.01)
*B41J 2/045* (2006.01)

(52) U.S. Cl.
CPC ..... *B41J 2/17523* (2013.01); *B41J 2/045* (2013.01); *B41J 2/175* (2013.01); *B41J 2/17563* (2013.01); *B41J 2002/17516* (2013.01)

(58) Field of Classification Search
CPC ..... B41J 2/175; B41J 2/17563
See application file for complete search history.

(56) References Cited

U.S. PATENT DOCUMENTS

| | | | | |
|---|---|---|---|---|
| 5,486,855 | A | 1/1996 | Carlotta | |
| 5,595,223 | A | 1/1997 | Hayao | |
| 5,801,727 | A | 9/1998 | Torpey | |
| 6,010,211 | A | 1/2000 | Betschon | |
| 6,188,417 | B1 | 2/2001 | Keefe et al. | |
| 6,273,560 | B1 | 8/2001 | Keefe | |
| 6,312,115 | B1 | 11/2001 | Hara | |
| 6,511,165 | B1 * | 1/2003 | Barinaga | B41J 2/17523 347/85 |
| 6,733,115 | B2 | 5/2004 | Santhanam | |
| 6,752,493 | B2 | 6/2004 | Dowell et al. | |
| 6,773,097 | B2 | 8/2004 | Dowell | |
| 6,874,873 | B2 | 4/2005 | Thielman et al. | |

(Continued)

FOREIGN PATENT DOCUMENTS

| | | |
|---|---|---|
| EP | 0839659 A1 | 5/1998 |
| EP | 1623836 A2 | 2/2006 |

(Continued)

*Primary Examiner* — Sharon A Polk
(74) *Attorney, Agent, or Firm* — HP Inc. Patent Department

(57) ABSTRACT

In one example implementation, a printhead assembly includes a fluid intake section, a fluid interconnect integrated with the fluid intake section to receive fluid from an ink supply assembly, and an air-permeable, fluid-resistant, fluid interconnect cover installed over the fluid interconnect.

20 Claims, 4 Drawing Sheets

(56) References Cited

U.S. PATENT DOCUMENTS

| | | | | |
|---|---|---|---|---|
| 7,883,189 | B2 | 2/2011 | Esdaile-Watts | |
| 9,493,008 | B2 * | 11/2016 | Wilson | B41J 2/045 |
| 2003/0067521 | A1 | 4/2003 | Kaga et al. | |
| 2005/0168540 | A1 | 8/2005 | Wilson | |
| 2007/0296775 | A1 | 12/2007 | Lee et al. | |
| 2008/0303879 | A1 | 12/2008 | Nip et al. | |
| 2012/0019605 | A1 | 1/2012 | Devries et al. | |
| 2012/0200646 | A1 | 8/2012 | Karasawa et al. | |

FOREIGN PATENT DOCUMENTS

| | | | |
|---|---|---|---|
| TW | 200824921 | A | 6/2008 |
| TW | 200938385 | A | 9/2009 |
| TW | 201111180 | A | 4/2011 |
| TW | 201231301 | A | 8/2012 |

* cited by examiner

PRINTHEAD ASSEMBLY WITH FLUID INTERCONNECT COVER

BACKGROUND

Inkjet printing systems include scanning type systems and single-pass systems that deliver ink to printable media through printheads. In single-pass printing systems, a printhead assembly includes multiple printheads on a print bar that is pre-filled with an internal ink supply. The print bar spans the width of the media and ejects ink as the media continually advances in a direction perpendicular to the print bar. In scanning type printing systems, printhead assemblies include a printhead integrated on a cartridge that has an internal ink supply. One or more cartridges are held by a scanning carriage that scans back and forth across the media as the media is incrementally advanced in a direction perpendicular to the scanning. In either case, the printhead assemblies (i.e., print bars pre-filled with ink, individual print cartridges) encounter water loss during shipping and storage. Water loss can result in print quality defects and reduced printhead life.

BRIEF DESCRIPTION OF THE DRAWINGS

Example implementations will now be described with reference to the accompanying drawings, in which.

Throughout the drawings, identical reference numbers designate similar, but not necessarily identical, elements.

DETAILED DESCRIPTION

Overview

Figure 1:
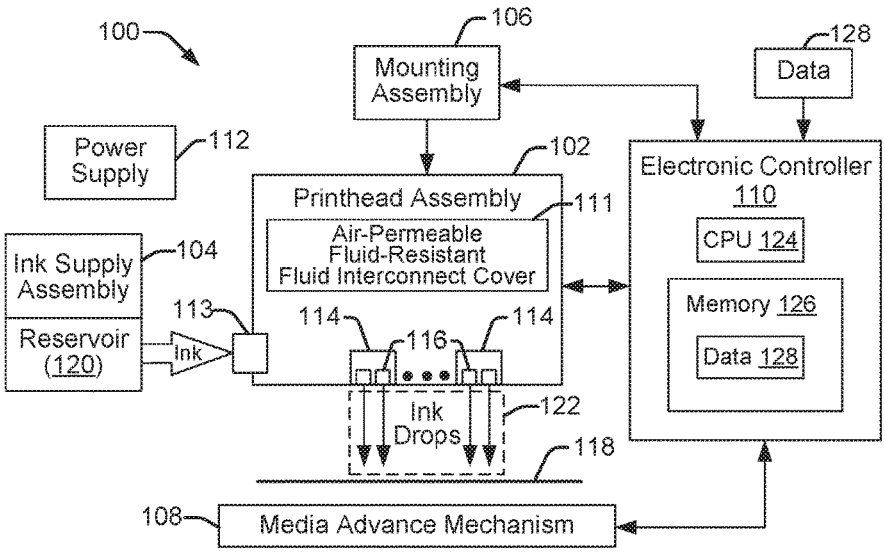
FIG. 1 shows an inkjet printing system suitable for implementing printhead assemblies having air-permeable, fluid-resistant, fluid interconnect covers, according to an example implementation.

As noted above, printhead assemblies that include one or more printheads and an internal integrated ink supply (e.g., print bars pre-filled with ink, print cartridges) can encounter water loss during shipping and storage that results in print quality defects and reduced printhead life. Water loss can occur, for example, through evaporation between seals that join different sections of the printhead assembly, such as manifold, filtration, and pressure regulation sections. In addition, movement during shipping, as well as altitude and temperature variations encountered during shipping, can cause ink or other printhead fluid to spill out or be expelled from the printhead assembly through its fluid interconnects.

As water is lost from a printhead assembly, the decreasing fluid volume creates an increasing negative pressure or vacuum within the assembly. The negative internal pressure can be relieved by an ingestion of air proportionate in volume to the lost water. In the case of refillable printhead assemblies, such as pre-filled page-wide-array (PWA) print bars, air can be ingested either through the printhead nozzles or through the fluid interconnect ports (e.g., fluid interconnect needles). Air ingested through the printhead nozzles causes problems such as ink blockage and poor nozzle performance. Air ingested through the fluid interconnects, however, does not cause such problems, as it generally collects in areas of the assembly housing where it can be removed through various purging techniques. Therefore, allowing air to enter the assembly through the fluid interconnects is desirable because it alleviates internal negative pressure from water loss but avoids air ingestion through printhead nozzles.

Prior solutions that address the water loss and ink spillage from printhead assemblies have mainly involved sealing the assemblies within a pouch and sealing off the fluid interconnects to the assemblies. A pouch is typically made of a metalized material that provides a high barrier to both water loss and air infiltration, and thus maintains the printhead assembly in a humidified atmosphere. The pouch solution works well for smaller, individual print cartridges that have a single printhead and an internal/integrated ink supply. However, a pouch is not practicable for larger PWA print bars with multiple printheads that are pre-filled at a factory with an internal ink supply. Pre-filled PWA print bars begin losing water from the moment they are filled at the factory, and as noted above, they can spill ink through the fluid interconnects during shipping. Print bars are typically shipped from a factory to another location where they are then installed into printers. Printers with pre-installed print bars are then shipped to customers. Neither a print bar nor a printer with a pre-installed print bar are suitable for shipment within a pouch.

To avoid ink spilling out of printhead assemblies through fluid interconnects during shipping, print bars have typically been shipped with seals that cover the fluid interconnects, such as rubber plugs. Prior fluid interconnect seals are impervious to both air and fluid, however, and this attribute unfortunately prevents air from entering the print bar through the interconnects to offset the volume of water being lost through evaporation. Thus, prior interconnect seals do not address the challenge of avoiding undesirable air ingestion through printhead nozzles. Furthermore, the impervious nature of prior fluid interconnect seals often inhibits the seals from preventing ink spilling out of the printhead assembly through the interconnects, because the seals can pop off during shipping due to altitude and temperature variations that cause air within the print bar to expand and contract.

Example printhead assemblies disclosed herein comprise air-permeable, fluid resistant, fluid interconnect covers or seals that improve on prior efforts to reduce the adverse effects of water loss, while also preventing fluid from spilling out of the assemblies through the fluid interconnects. The air-permeable, fluid resistant, fluid interconnect covers allow air to enter the printhead assembly which compensates for the volume of water within the assembly lost during shipping and/or storage. The diffusion of air through the covers alleviates the build up of negative pressure within the assembly and avoids harmful ingestion of air through the printhead nozzles. The air-permeable, fluid resistant, covers allow air to collect upstream of a pressure regulator within a print bar where it can be removed through standard purge routines within the printer. The air-diffusivity and expandability of the fluid interconnect covers also reduce the chances that the covers will pop off during altitude and temperature excursions, which decreases the likelihood that printhead fluid (e.g., ink) will be spilled out of, or expelled from, the printhead assembly through the fluid interconnects.

In one example implementation, a printhead assembly includes a fluid intake section, a fluid interconnect integrated with the fluid intake section to receive fluid from an ink supply assembly, and an air-permeable, fluid-resistant, fluid interconnect cover installed over the fluid interconnect. An example of such a fluid interconnect cover includes an air-permeable, fluid-resistant, fluid interconnect plug comprising a bladder section that enables air to diffuse through bladder walls and into an interior bladder cavity, and retains fluid that escapes from the fluid interconnect.

In another example implementation, a printhead assembly comprises a page-wide-array print bar that includes, a printhead array section comprising multiple printheads, a manifold section to route ink through the print bar to different printheads in the printhead array section, a filter section to filter the ink, a pressure regulation section to regulate ink pressure within the print bar, a fluid intake section to receive the ink and route it to the pressure regulation section, a fluid interconnect on the fluid intake section, and an air-permeable, fluid-resistant fluid interconnect cover to cover the fluid interconnect.

Illustrative Embodiments

FIG. 1 illustrates an inkjet printing system 100 suitable for implementing printhead assemblies having air-permeable, fluid-resistant, fluid interconnect covers, according to an example implementation. Inkjet printing system 100 includes an inkjet printhead assembly 102, an ink supply assembly 104, a mounting assembly 106, a media advance mechanism 108, an electronic controller 110, and at least one power supply 112 that provides power to the various electrical components of inkjet printing system 100. Inkjet printhead assembly 102 includes at least one air-permeable, fluid-resistant, fluid interconnect cover 111, to cover, plug and/or seal fluid interconnect(s) 113 on printhead assembly 102, as discussed in more detail below. Inkjet printhead assembly 102 also includes at least one printhead 114 that ejects drops of ink through a plurality of orifices or nozzles 116 toward a media page 118 to print onto the media page 118. Printhead 114 is implemented, for example, as a thermal inkjet (TIJ) printhead or a piezoelectric inkjet (PIJ) printhead. A TIJ printhead implements a thermal resistor ejection element within an ink chamber to vaporize ink and create bubbles that force ink or other fluid drops out of a nozzle 116, while a PIJ printhead implements a piezoelectric material actuator ejection element to generate pressure pulses that force ink drops out of a nozzle. Typically, nozzles 116 are arranged in one or more columns or arrays such that properly sequenced ejection of ink from nozzles 116 causes characters, symbols, and/or other graphics or images to be printed upon a media page 118 as the inkjet printhead assembly 102 and media page 118 are moved relative to each other. A media page 118 can be any suitable type of rolled or cut sheet print media, such as paper, card stock, transparencies, Mylar, and the like.

Ink supply assembly 104 supplies fluid ink to printhead assembly 102 and includes a reservoir 120 for storing ink. Ink flows from reservoir 120 to inkjet printhead assembly 102. In one implementation, ink supply assembly 104 is separate from inkjet printhead assembly 102 and supplies ink to inkjet printhead assembly 102 through a fluid interconnect 113 on the printhead assembly 102. For example, a fluid interconnect 113 on printhead assembly 102 may comprise a fluid interconnect needle that penetrates a septum of the ink supply assembly 104 when the supply assembly 104 is installed in the printing system 100, allowing ink to flow from the supply assembly 104 to the printhead assembly 102. In another implementation, inkjet printhead assembly 102 and ink supply assembly 104 are housed together in an inkjet cartridge or pen. In this case, reservoir 120 includes a local reservoir located within the cartridge, but may also include a larger reservoir located separately from the cartridge to refill the local reservoir through a fluid interconnect, such as a supply tube or interconnect needle. In different implementations, an ink supply assembly 104 and/or reservoir 120 can be removed, replaced, and/or refilled.

Mounting assembly 106 positions the printhead assembly 102 relative to the media advance mechanism 108, and the media advance mechanism 108 positions a media page 118 relative to the printhead assembly 102. Thus, a print zone 122 is defined adjacent to nozzles 116 in an area between the printhead assembly 102 and media page 118. In one implementation, inkjet printing system 100 is a scanning type printer that scans inkjet printhead assembly 102 back and forth across the media page 118 as the media advance mechanism 108 incrementally advances the page 118 between scans. In another implementation, inkjet printing system 100 is a single-pass printer with a printhead assembly 102 configured as a page-wide-array (PWA) print bar having multiple printheads 114 to eject ink onto the media page 118 as the media advance mechanism 108 continuously advances the page 118. Thus, media advance mechanism 108 moves the media page 118 through the printer 100 along a print media path that properly positions the page 118 relative to inkjet printhead assembly 102 as drops of ink are ejected onto the page 118. Media advance mechanism 108 can include, for example, a variety of media advance rollers, a moving platform, a motor such as a DC servo motor or a stepper motor to power the media advance rollers and/or moving platform, combinations of such mechanisms, and so on.

Referring still to FIG. 1, electronic controller 110 includes a processor (CPU) 124, a memory 126, firmware, and other printer electronics for communicating with and controlling inkjet printhead assembly 102, mounting assembly 106, and media advance mechanism 108. Memory 126 comprises a non-transitory computer/processor-readable storage medium that can include any device or non-transitory medium able to store code and/or data for use by a computer system. Thus, memory 126 can include, but is not limited to, volatile (i.e., RAM) and nonvolatile (e.g., ROM, hard disk, floppy disk, CD-ROM, etc.) memory components comprising computer/processor-readable media that provide for the storage of computer/processor-readable coded instructions, data structures, program modules, and other data for printing system 100.

Electronic controller 110 receives data 128 from a host system, such as a computer, and stores the data 128 in memory 126. Data 128 represents, for example, a document or image file to be printed. As such, data 128 forms a print job for inkjet printing system 100 that includes one or more print job commands and/or command parameters. Thus, using data 128, electronic controller 110 controls inkjet printhead assembly 102 to eject ink drops from nozzles 116 onto a media page 118 to define patterns of ejected ink drops that form characters, symbols, and/or other graphics or images on the page 118.

Figure 2:
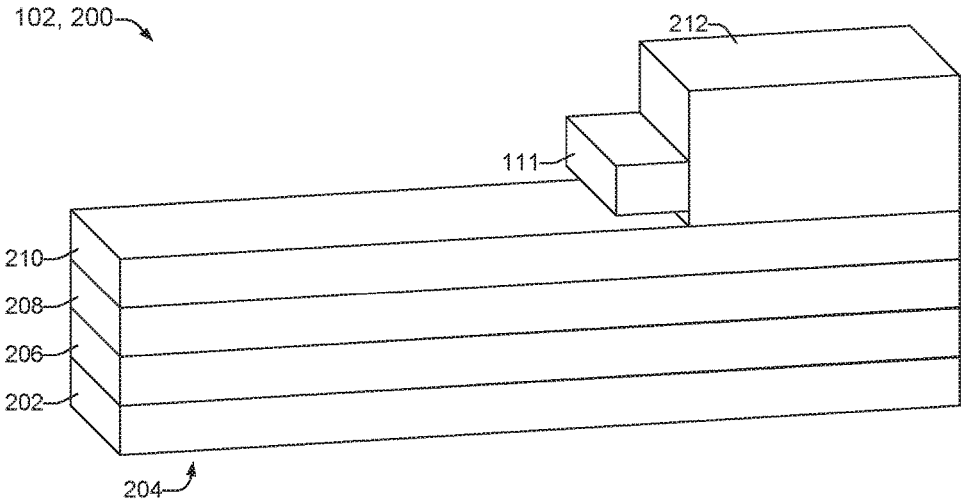
FIG. 2 shows a block diagram view of an example inkjet printhead assembly implemented as a page-wide-array print bar, according to an example implementation.

FIG. 2 shows a block diagram view of an example inkjet printhead assembly 102 implemented as a PWA print bar 200. The print bar 200 includes several functional sections that operate to receive printhead fluid (e.g., ink), regulate the fluid's pressure, filter the fluid, route the fluid to appropriate printhead slots, and eject the fluid as fluid drops in controlled ejection sequences. The sections of print bar 200 include a printhead array section 202 that includes multiple printheads 114 on the underside 204 of the printhead array section 202. Above the printhead array section 202 is a manifold section 206 that routes one or more colors of ink through the interior of the print bar 200 to different printheads 114 in the printhead array section 202. Above the manifold section 206 is a filter section 208 that filters ink to remove particulate matter before the ink is routed through the manifold section 206 to the printheads 114. Above the filter section 208 is a pressure regulation section 210 that regulates the fluid pressure within the print bar 200.

The print bar 200 also includes a fluid intake section 212 above the regulation section 210 that receives ink, and functions as an upper manifold to route the ink to appropriate regulators within the pressure regulation section 210. The fluid intake section 212 receives ink through fluid interconnects 113 from one or more ink supply assemblies 104 (not shown in FIG. 2). In place of the fluid interconnects 113 and ink supply assemblies 104. FIG. 2 shows the print bar 200 having an air-permeable, fluid-resistant, fluid interconnect cover 111. In general, print bar 200 includes one or more fluid interconnect covers 111 that cover the fluid interconnect(s) 113 during shipping and storage of the print bar 200. The fluid interconnect cover(s) 111 typically remain in place on the print bar 200 until the printer 100 is ready for use, after which they are removed and one or more ink supply assemblies 104 are installed.

Figure 3:
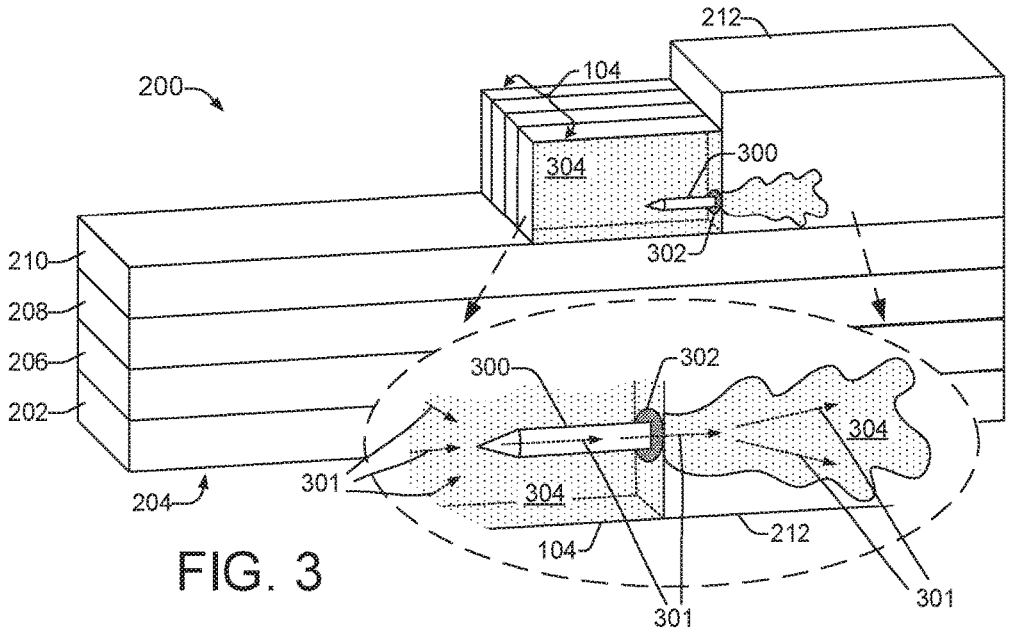
FIG. 3 shows a perspective view of a page-wide-array print bar with ink supply assemblies installed onto fluid interconnects, according to an example implementation.

FIG. 3 shows a perspective view of an example implementation of a PWA print bar 200 (i.e., a printhead assembly 102) where the fluid interconnect cover(s) 111 have been removed from the fluid interconnects 113 and ink supply assemblies 104 have been installed in their place. A cutaway portion of FIG. 3 shows the interior of an ink supply assembly 104 installed on the print bar 200. In this example, ink supply assemblies 104 are implemented as ink supply cartridges 104, and each fluid interconnect 113 comprises an elongated fluid interconnect needle 300 that pierces a septum 302 in a respective ink supply cartridge 104 when the supply cartridge 104 is installed in the printer 100. The installation of the ink supply cartridges 104 in this manner enables ink 304 and/or other fluid to flow from the cartridges 104 through the fluid interconnect needles 300 into the fluid intake section 212 of the print bar 200, as indicated by the dashed direction arrows 301 in FIG. 3.

Figure 4A:
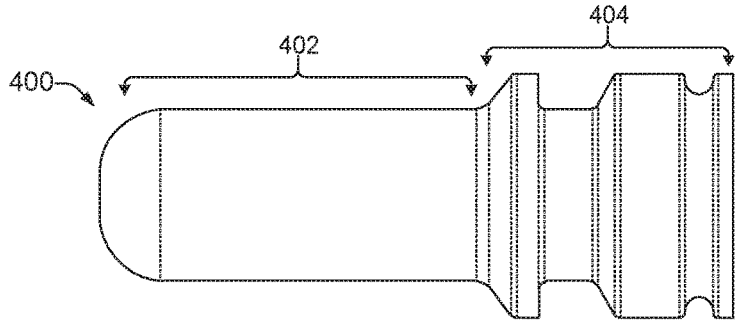
FIGS. 4*a* and 4*b* show an air-permeable, fluid-resistant, fluid interconnect cover that is suitable for covering fluid interconnects of a printhead assembly, such as a page-wide-array print bar, according to an example implementation.
Figure 4B:
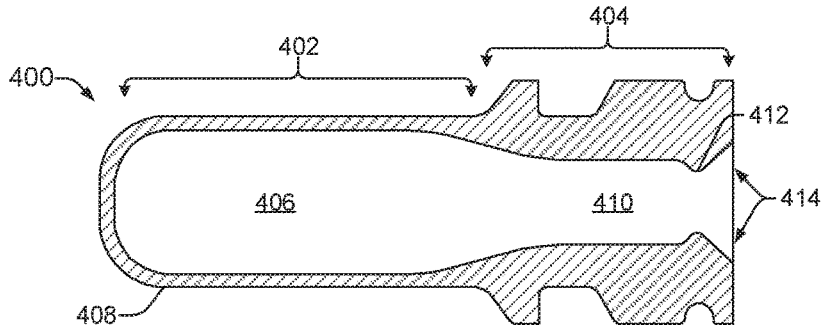

FIGS. 4*a* and 4*b* show an example implementation of an air-permeable, fluid-resistant, fluid interconnect cover 111 that is suitable for covering fluid interconnects 113 of a printhead assembly 102, such as a PWA print bar 200. In this example, the fluid interconnect cover 111 comprises an air-permeable, fluid-resistant, fluid interconnect plug 400 configured to cover an elongated fluid interconnect needle 300. FIG. 4*a* shows a side view of the outside of the fluid interconnect plug 400, while FIG. 4*b* shows a cross-sectional side view of the fluid interconnect plug 400. In general, the air-permeable, fluid-resistant, fluid interconnect covers 111 disclosed herein, such as the fluid interconnect plug 400, are configured to reduce the impact of water loss from the printhead assembly 102 and to prevent ink or other fluid from spilling out and away from the assembly 102 through the fluid interconnects 113. In addition, the compliant nature of the interconnect plug 400 allows it to expand during high altitude excursions (e.g., during shipping of the printhead assembly 102) in which the internal pressure of the printhead assembly 102 exceeds its external pressure, thus enabling the plug 400 to remain in place over the fluid interconnect needle 300.

Figure 5:
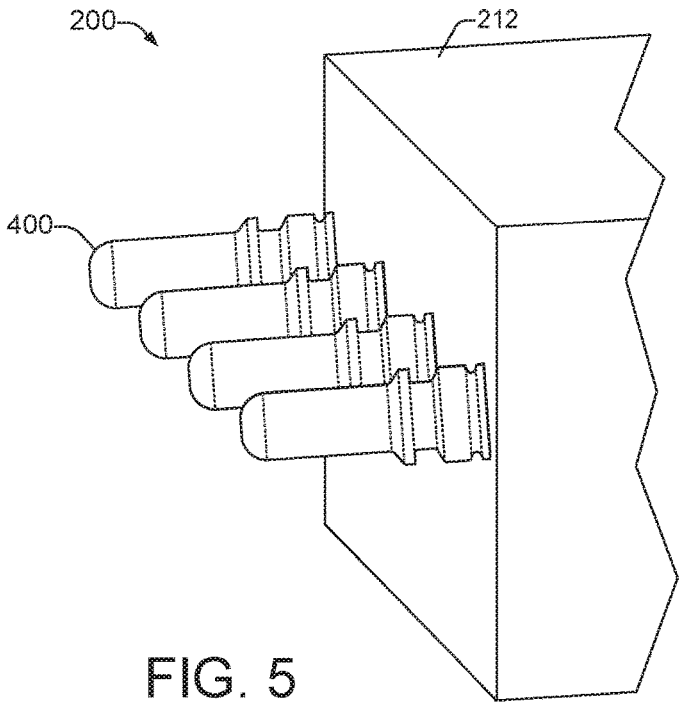
FIG. 5 shows a partial perspective view of a print bar having four air-permeable, fluid-resistant, fluid interconnect plugs installed over fluid interconnects of a fluid intake section on a print bar, according to an example implementation.
Figure 6:
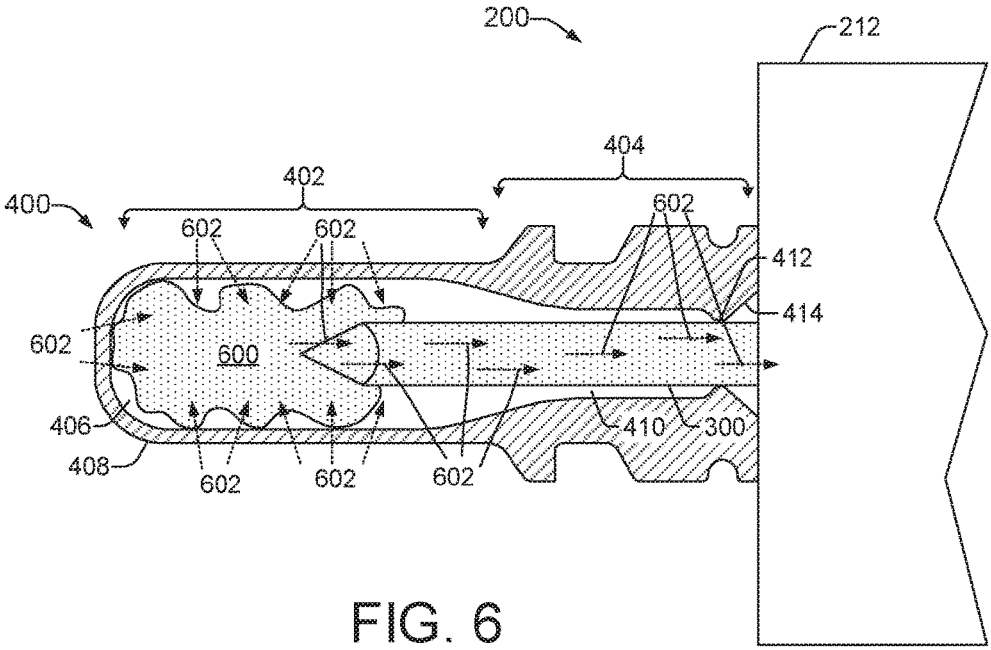
FIG. 6 shows a cross-sectional, side view of an air-permeable, fluid-resistant, fluid interconnect plug installed over a fluid interconnect needle, according to an example implementation.

FIG. 5 shows a partial perspective view of an example print bar 200 having four air-permeable, fluid-resistant, fluid interconnect plugs 400 installed over fluid interconnects 113 on the fluid intake section 212 of the print bar 200. Each plug 400 covers an elongated fluid interconnect needle 300 (not shown in FIG. 5), or some other similarly configured fluid interconnect 113 device. In general, each fluid interconnect 113, 300, on print bar 200 enables the transfer of ink from an installed ink supply assembly 104 that contains a particular color of ink. Therefore, the example print bar 200 shown in FIG. 5 is configured to receive four different ink colors, one through each of four fluid interconnects 113, 300, upon the installation of four different color ink supply assemblies 104. The fluid interconnect plugs 400 are typically installed over the fluid interconnect needles 300 after the print bar 200 has been pre-filled with fluid, and they remain in place when the print bar 200 is installed into a printer 100 and until the printer has been shipped and is ready for use. FIG. 6 shows a cross-sectional, side view of an example air-permeable, fluid-resistant, fluid interconnect plug 400 installed over a fluid interconnect needle 300.

Referring generally to FIGS. 4, 5, and 6, the air-permeable, fluid-resistant, fluid interconnect plug 400 includes a thin-walled bladder section 402 and a neck section 404. As shown in FIG. 6, the thin-walled bladder section 402 retains printhead fluid 600 that escapes from the fluid interconnect needle 300 during movement, such as the movement encountered during shipping. Fluid 600 that escapes the print bar 200 through interconnect needle 300 is held within an interior bladder cavity 406 of the plug 400 and cannot pass through the fluid-resistant walls 408. Retaining printhead fluid 600 within the interior bladder cavity 406 of the plug 400 prevents the fluid from spilling out and away from the print bar 200 into other areas of the printer 100. The thin-walled bladder section 402 also allows air 602 (shown as dashed arrows 602) to diffuse through its outer walls 408 and into its interior bladder cavity 406 in response to a negative pressure build-up within the print bar 200. Air 602 diffusing into the interior bladder cavity 406 travels through the fluid interconnect needle(s) 300 and into the fluid intake section 212 of the print bar 200. This diffusion process alleviates the build up of negative pressure within the print bar 200 caused by the evaporation of water from the print bar 200, which helps prevent the harmful ingestion of air through the printhead nozzles 116. A compliant material (discussed below) is used to form the interconnect plug 400 that enables the thin-walled bladder section 402 to expand like a small balloon. This expandable property helps the plug 400 remain in place over the fluid interconnect during high altitude excursions (e.g., during shipping) in which air within the print bar 200 expands. The neck section 404 of the fluid interconnect plug 400 has thicker walls than the bladder section 402. The walls of the neck section 404 vary in thickness and shape to provide an external topography that enables users to readily handle the plug 400 during installation and removal.

The dimensions of the air-permeable, fluid-resistant, fluid interconnect plug 400 depend at least in part on the size of the fluid interconnect needle 300 (or other fluid interconnect 113) the plug 400 is designed to cover. In one implementation, the fluid interconnect plug 400 is on the order of 20 mm in length, with an inner diameter in the range of approximately 6 to 2 mm from the interior bladder cavity 406 to an interior neck cavity 410. The thickness of the plug walls 408 varies from one end of the plug 400 to the other, but in some implementations the thickness of the thin-walled bladder section 402 is on the order of 0.5 mm. The diameter of the interior bladder cavity 406 tapers down in size to a smaller diameter within the interior neck cavity 410. The smaller diameter of the interior neck cavity 410 enables a firm fluidic seal to develop around the fluid interconnect needle 300 when the plug 400 is installed over the interconnect needle 300. In some implementations, the diameter of the interior neck cavity 410 tapers down further to form a pinch section 412 that firmly grasps the fluid interconnect needle 300 and further prevents fluid from escaping the plug 400. The fluid interconnect plug 400 also includes a flared entrance 414 area that facilitates the installation of the plug 400 over the fluid interconnect needle 300.

The fluid interconnect plug 400 can be formed of any air-permeable, fluid resistant material that allows air to diffuse through its outer walls 408 and into its interior bladder cavity 406, while also preventing liquid (e.g., ink) from passing through the walls 408 from its interior cavity 406 to the outside of the plug 400. Furthermore, such material is compliant and enables the thin-walled bladder section 402 to expand like a small balloon under conditions in which the internal pressure of the printhead assembly 102 (e.g., print bar 200) exceeds its external pressure, such as during transportation at high altitudes. Such materials can include, for example, polyisoprene, santoprene, silicone, EPDM (ethylene propylene diene monomer (M-class) rubber), polyethelene, Teflon, Gor-Tex, polyvinylidene fluoride, combinations thereof, and the like.

The dimensions and material composition of an air-permeable, fluid-resistant, fluid interconnect cover 111, in general, depend upon the amount of water loss expected from the printhead assembly 102 (e.g., print bar 200). However, the rate of water loss from one assembly to another can vary. In addition, the amount of water lost from a printhead assembly 102 depends on the amount of time that expires between when the assembly 102 is pre-filled with printhead fluid and when the assembly 102 begins being used. Therefore, the greater the storage and/or shipping time is for a given printhead assembly 102, the higher the water loss will be for that assembly 102. As noted above, the process of air diffusing through the walls of the interconnect cover 111 occurs when there is a build up of negative pressure within the assembly 102. However, the air diffusion does not occur when there is no negative pressure. Accordingly, in view of the difficulty noted in determining the amount of water that will be lost from a printhead assembly 102, the dimensions and material composition of an air-permeable, fluid-resistant, fluid interconnect cover 111, should be selected to accommodate the largest expected amount of water loss from the printhead assembly 102. In general, fluid interconnect covers 111 with larger diffusive surface areas (e.g., greater bladder wall areas in a fluid interconnect plug 400) that are formed out of materials having greater air-permeability (but that are still fluid restrictive), will provide sufficient air diffusivity to accommodate larger volumes of water loss from a printhead assembly 102. Cost and ease of use are also factors to be considered in the dimensions and material composition of an air-permeable, fluid-resistant, fluid interconnect cover 111.

Figure 7:
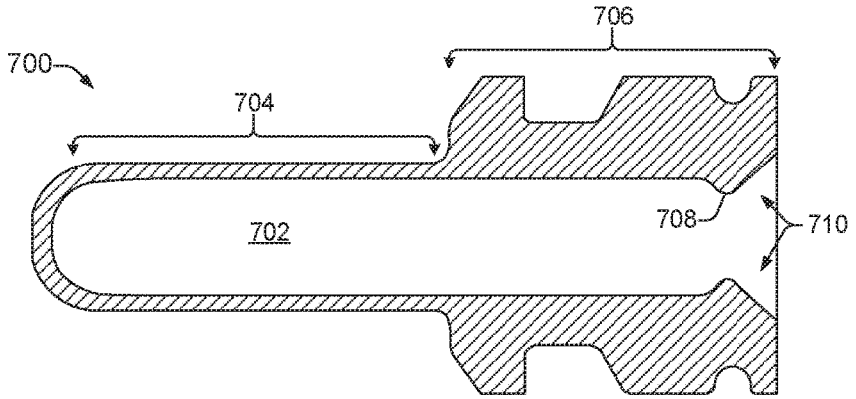
FIG. 7 shows a cross-sectional, side view of an air-permeable, fluid-resistant, fluid interconnect cover that comprises a differently shaped fluid interconnect plug, according to an example implementation.

While one example of an air-permeable, fluid-resistant, fluid interconnect cover 111 for a printhead assembly 102 has been described, any number of other interconnect covers 111 having different sizes, shapes and configurations may be suitable, and are contemplated by this disclosure. For example, FIG. 7 shows a cross-sectional side view of another example implementation of an air-permeable, fluid-resistant, fluid interconnect cover 111 that comprises a differently shaped fluid interconnect plug 700. Like the interconnect plug 400 discussed above, the fluid interconnect plug 700 is configured to cover an elongated fluid interconnect needle 300. However, the fluid interconnect plug 700 has a different shape, that includes a smaller interior bladder cavity 702 that does not taper down toward one end of the plug 700. The fluid interconnect plug 700 includes a thin-walled bladder section 704 and a neck section 706 having thicker walls that vary in thickness and shape to enable users to readily handle the plug 700 during installation and removal. The diameter of the interior bladder cavity 702 tapers down to form a pinch section 708 that firmly grasps the fluid interconnect needle 300 to prevent fluid from escaping the plug 700. The plug 700 also includes a flared entrance 710 area that facilitates the installation of the plug 700 over a fluid interconnect 111, such as a fluid interconnect needle 300.

Figure 8:
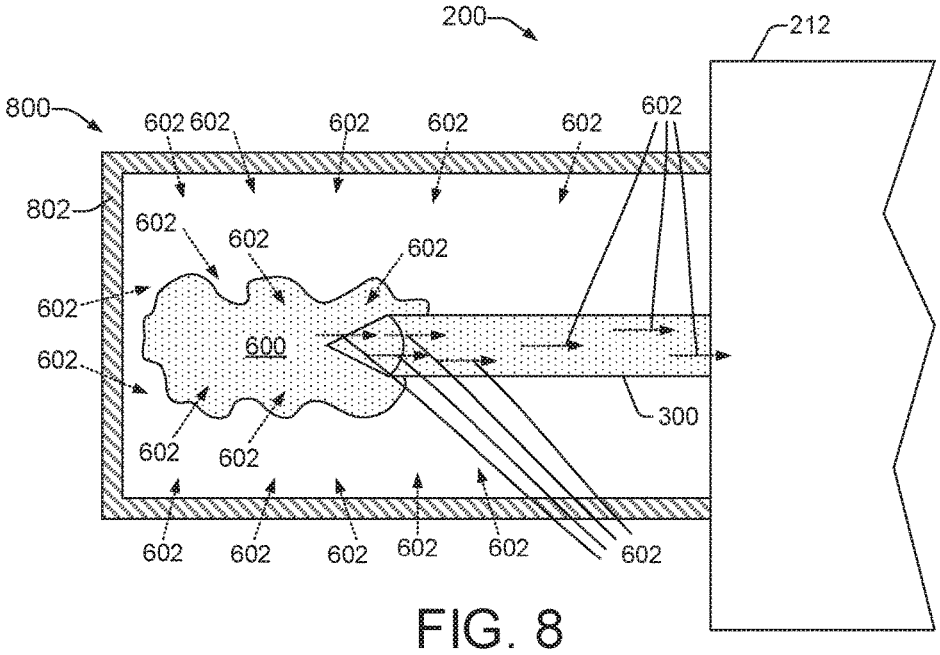
FIG. 8 shows a cross-sectional, side view of an air-permeable, fluid-resistant, box-shaped, fluid interconnect cover, according to an example implementation.

FIG. 8 shows a cross-sectional side view of another example implementation of an air-permeable, fluid-resistant, fluid interconnect cover 111 for a printhead assembly 102 (e.g., print bar 200) that comprises a box-shaped cover 800. The box-shaped fluid interconnect cover 800 comprises an internal lining 802 that is formed of an air-permeable, fluid resistant material, such as any of the materials discussed above, and is configured to be installed over a fluid interconnect 113 such as a fluid interconnect needle 300. While a box-shaped cover 800 is shown and discussed, it should be apparent that many other supportive structural shapes having an internal, air-permeable, fluid resistant material lining may also be suitable for use as a fluid interconnect cover 800. The box-shaped fluid interconnect cover 800 functions in the same general manner as discussed above to retain printhead fluid 600 that escapes from the fluid interconnect needle 300 during movement, and prevent the fluid from spilling out and away from the print bar 200 into other areas of the printer 100. The internal lining of the interconnect cover 800 allows air 602 (shown as dashed arrows 602) to diffuse through the walls of the box cover 800 and into an internal cavity of the cover 800 in response to negative pressure build-up within the print bar 200. Air 602 diffusing into the internal cavity travels through the fluid interconnect needle 300 and into the fluid intake section 212 of the print bar 200, which alleviates the build up of negative pressure within the print bar 200 caused by the loss of water from the fluid ink.

What is claimed is:

1. A printhead assembly comprising:

a fluid intake section;

a fluid interconnect integrated with the fluid intake section to receive fluid from a fluid supply assembly; and an expandable, air-permeable, fluid-resistant, fluid interconnect plug installed over the fluid interconnect.

2. The printhead assembly of claim 1, wherein:

the fluid interconnect is a fluid interconnect needle; and the expandable, air-permeable, fluid-resistant, fluid interconnect plug covers the fluid interconnect needle.

3. The printhead assembly of claim 1, wherein one expandable, air-permeable, fluid-resistant, fluid interconnect plug covers multiple fluid interconnects.

4. The printhead assembly of claim 1, wherein the expandable, air-permeable, fluid-resistant, fluid interconnect plug expands when an internal pressure of the printhead assembly exceeds an external pressure.

5. The printhead assembly of claim 1, wherein the expandable, air-permeable, fluid-resistant, fluid interconnect plug further comprises:

an internal pinch section to form a fluidic seal around the fluid interconnect; and a flared entrance to facilitate the installation of the expandable, air-permeable, fluid-resistant, fluid interconnect plug over the fluid interconnect.

6. The printhead assembly of claim 1, wherein the expandable, air-permeable, fluid-resistant, fluid interconnect plug is sized based on a shipping time for the printhead assembly.

7. The printhead assembly of claim 1, wherein the expandable, air-permeable, fluid-resistant, fluid interconnect plug is sized based on an expected amount of water loss from the printhead assembly.

8. The printhead assembly of claim 1, wherein the expandable, air-permeable, fluid-resistant, fluid interconnect plug is box-shaped.

9. A fluid cartridge comprising the printhead assembly of claim 1, the fluid cartridge further comprising:

a fluid supply assembly to store fluid; and the printhead assembly in fluid communication with the fluid supply assembly.

10. The fluid cartridge of claim 9, wherein:

the at least one fluid interconnect comprises at least two fluid interconnects;

the at least one expandable air-permeable, fluid-resistant, fluid interconnect plug comprises at least two expandable, air-permeable, fluid-resistant, fluid interconnect plugs; and each of the at least two expandable, air-permeable, fluid-resist fluid interconnect plugs cover one of the at least two fluid interconnects.

11. The fluid cartridge of claim 9, wherein the at least one expandable, air-permeable, fluid-resistant, fluid interconnect plug is formed of a compliant material.

12. The fluid cartridge of claim 9, wherein the at least one expandable, air-permeable, fluid-resistant, fluid interconnect plug further comprises:

a first section having walls of a first thickness; and a second section having walls of a second thickness, wherein the second thickness is greater than the first thickness.

13. A page-wide-array print bar comprising the printhead assembly of claim 1.

14. The print bar of claim 13, wherein the page-wide-array print bar is a pre-filled page-wide-array print bar.

15. The print bar of claim 13, wherein the page-wide-array print bar further comprises a printhead array section comprising a plurality of the printhead assemblies.

16. The printhead assembly of claim 1, wherein the expandable, air-permeable, fluid-resistant, fluid interconnect plug comprises an interior cavity to retain fluid that escapes the printhead assembly through the fluid interconnect.

17. The printhead assembly of claim 16, wherein the interior cavity tapers towards the fluid intake section.

18. The printhead assembly of claim 16, wherein the interior cavity is straight.

19. The printhead assembly of claim 1, wherein the expandable, air-permeable, fluid-resistant, fluid interconnect plug is 20 millimeters long.

20. The printhead assembly of claim 1, wherein the expandable, air-permeable, fluid-resistant, fluid interconnect plug has a varying inner diameter in the range of 2 millimeters to 6 millimeters.

* * * * *